United States Patent [19]

Beér et al.

[11] Patent Number: 4,539,918

[45] Date of Patent: Sep. 10, 1985

[54] MULTIANNULAR SWIRL COMBUSTOR PROVIDING PARTICULATE SEPARATION

[75] Inventors: János M. Beér, Winchester, Mass.; James A. Dilmore, Irwin, Pa.; Géza Vermes, Lower Merion Township, Montgomery County, Pa.; William E. Young, Churchill, Pa.

[73] Assignee: Westinghouse Electric Corp., Pittsburgh, Pa.

[21] Appl. No.: 663,531

[22] Filed: Oct. 22, 1984

[51] Int. Cl.[3] ..... F23D 1/00

[52] U.S. Cl. ..... 110/266; 110/263; 110/265; 60/39.464; 431/351; 431/183

[58] Field of Search ..... 60/39.464; 110/216, 110/266, 263, 264, 265

[56] References Cited

U.S. PATENT DOCUMENTS 4,507,075 3/1985 Buss et al. ..... 110/265

*Primary Examiner*—Carroll B. Dority, Jr.

*Attorney, Agent, or Firm*—E. F. Possessky

[57] ABSTRACT

A multi-annular swirl burner includes a plurality of overlapping tubular wall members which form a rich combustion zone and a lean combustion zone with a throat section therebetween. Annular passages are located between adjacent wall members, and vanes located therein input a tangential velocity to entering air. The tangential velocity of the swirling flows increases with increasing radius to produce centrifugal separating force on particulates moving from the rich combustion zone to the throat section. A collection system scavenges particulates from the throat section for disposal.

6 Claims, 1 Drawing Figure

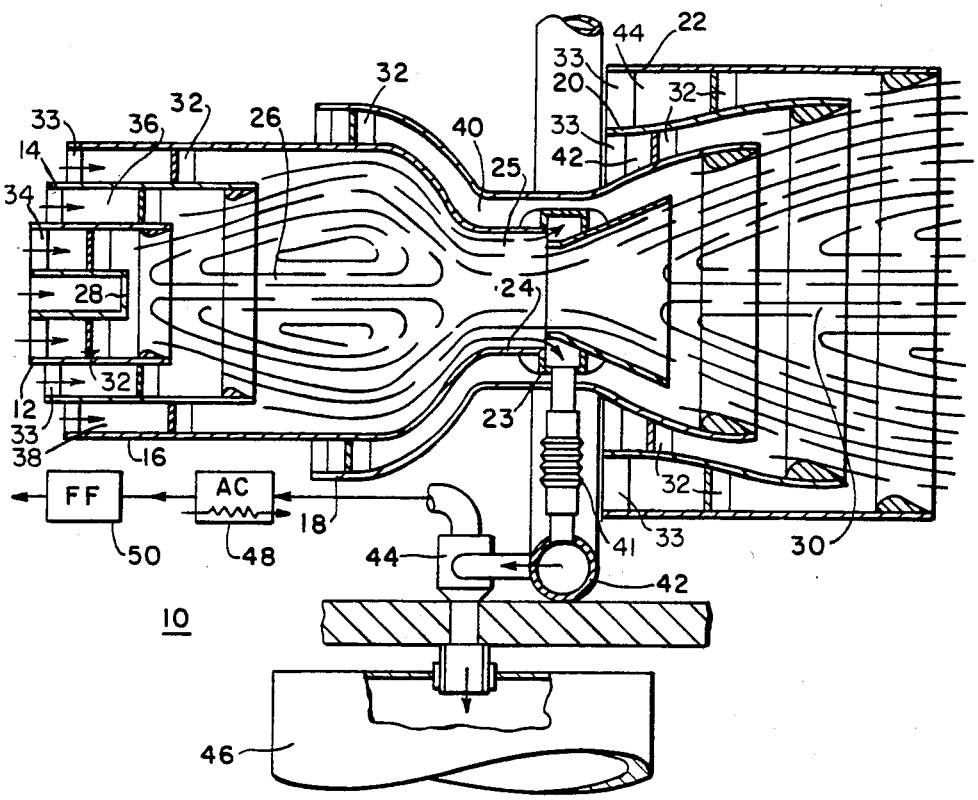
22
44
33
20
32
33
42
32
40
25
26
36
32
33
14
34
28
24
32
12
33
38
16
23
FF
AC
18
50
48
44
41
33
30
42
10
46

MULTIANNULAR SWIRL COMBUSTOR PROVIDING PARTICULATE SEPARATION

BACKGROUND OF THE INVENTION

The present invention relates to combustors for large combustion turbines and more particularly to combustors capable of satisfying emission and combustion performance requirements while burning fuel which carries particulate matter.

To achieve decreased dependence on oil as a fuel, it is desirable to develop a combustion turbine capability for burning pulverized coal which is often low in sulfur content as a result of the manner in which it is produced. While providing for the burning of pulverized coal, there is a simultaneous need to provide any new combustor with operating characteristics which meet both turbine combustion performance specifications and exhaust emission requirements.

As compared to the burning of coal in conventional boilers, special problems are encountered in burning pulverized coal in a combustion turbine since the combustion products are passed through the turbine blade path. Particulate matter in the combustion products can damage the vanes and blades through erosion and deposition and/or shorten the turbine operating life. Some protection can be provided against particulate carryover by a ruggedized turbine design but this is an expensive alternative with limited effectiveness. Similarly, the use of cleaning devices between the combustor and the expander is costly, structurally cumbersome and limited in effectiveness.

One recent basic development in the combustor art is a multi-annular swirl (MAS) burner. The MAS burner operates with respective rich and lean combustion zones where combustion vortices and recuperative cooling occur. The MAS burner provides efficient combustion for efficient turbine operation and is especially valuable in producing turbine operation reduced nitrogen oxide emissions. Reference is made to a copending application Ser. No. 488,145, entitled "Gas Turbine Combustor" filed by Janos M. Beer on May 25, 1982, now abandoned, and filed as a continuation application Ser. No. 661,264, filed Oct. 15, 1984, for more details on the MAS burner.

The present invention is directed to an improvement in the MAS combustor to provide a combustor capable of burning particulate carrying fuels like pulverized coal slurry, while satisfying turbine performance and exhaust emission requirements.

SUMMARY OF THE INVENTION

A two-stage rich-lean combustor operable with reduced emission of fuel-bound and thermal nitrogen oxide products ($NO_x$), said combustor comprising:

(a) a plurality of tubular members having differing axial lengths and disposed to form a burner basket of sufficient size and axial length to contain axially spaced rich and lean combustion zones which respectively generally diverge outwardly in the downstream direction;

(b) means for supporting said tubular members substantially concentrically and telescopically relative to each other to provide a generally annular path for inlet pressurized gaseous reactant or pressurized air flowing into said combustor with predetermined axial velocity between each tubular member and the next radially outwardly disposed tubular member;

(c) means for imparting a tangential velocity to gaseous reactant entering said combustor through each annular flow path with the tangential velocity of at least the flows entering the rich combustion zone increasing with increasing flow radius;

(d) nozzle means for supplying fuel to said combustor in at least one predetermined location;

(e) said tubular members having respective axial lengths and being so disposed that the axial location of the tubular member outlet ends combustion zone generally have increasing radii and respectively are located at successive downstream locations;

(f) said tangential velocity imparting means and the radial and axial geometry of at least two of said tubular members being coordinated under operating inlet gas pressure and gas axial velocity conditions to:

(1) define said rich combustion zone in an upstream portion of said combustor, where high temperature oxygen deficient combustion occurs with flame stabilizing recirculation flow and substantially without net $NO_x$ formation;

(2) produce a toroidal vortex in said rich combustion zone, with recirculating combustion air being recuperatively supplied substantially by the swirling inlet annular air flow after it has cooled the inner wall surfaces of said tubular members about said rich combustion zone; and (3) provide sufficient fuel particulate residence time in the rich combustion zone to permit particulate burning prior to centrifugal separation of particulates toward the combustor wall surface;

(g) said tangential velocity imparting means and the radial and axial geometry of at least two of said tubular members located outwardly from said tubular members about said rich combustion zone being coordinated under operating inlet gas pressure and gas axial velocity conditions to define said lean combustion zone and to produce a toroidal vortex in said lean combustion zone;

(h) said tubular members being arranged to provide a throat section into which said rich combustion zone converges and from which said lean combustion zone diverges; and (i) means for collecting and withdrawing from said combustor particulates separated from the flow as it passes through said throat section.

BRIEF DESCRIPTION OF THE DRAWING

The FIGURE shows a schematic view of an MAS combustor improved in accordance with the present invention to provide for the burning of particulate bearing fuels while satisfying performance and emission requirements.

DESCRIPTION OF THE PREFERRED EMBODIMENT

In the FIGURE, there is shown a combustor 10 constructed in accordance with the present invention to separate particulate matter out of the combustor gas flow while producing an outlet gas flow which meets turbine performance requirements with low $NO_x$ and other emissions. A plurality of the combustors 10 are provided in forming a combustion system for a combustion turbine (not shown).

Generally, the combustor 10 is formed by a plurality of concentric, axially overlapping tubular wall members or annular rings 12, 14, 16, 18, 20 and 22 with the members 16 and 18 shaped to form a convergent-divergent throat section 24. The tubular wall members 12, 14 and 16 define a rich combustion zone 26 which converges to the throat section 24 and which is supplied with fuel by a fuel nozzle 28 located at the head end of the combustor 10 along the combustor axis.

The tubular wall members 18, 20 and 22 define a diverging lean combustion zone 30 which diverges from the throat section 24 to the combustor outlet.

Annular passages 34, 36, 38, 40, 42 and 44 are formed between the tubular wall members to provide for entry of pressurized combustion air into the combustor 10 at spaced axial locations and generally along the axial direction. Vanes 32 are disposed in suitable number in circumferentially spaced relation in the annular passages to impart a swirl velocity component to entering air with the swirl velocity depending on the angular disposition of the vanes.

The vanes 32 may structurally support the annular wall members relative to each other, but it is preferred that the vanes be welded or otherwise secured at one end only to one wall member. The other end of each vane then is provided with a small amount of clearance (not visible in drawing because of small size) to allow for differential thermal expansion.

Preferably, the vanes 32 are aligned in a common solid plane, and further are positioned as far downstream as possible yet somewhat short of the downstream edge of the inner associated wall member—so that pressure losses are minimized while permitting the development of proper outgoing swirling flow.

Since the vanes 32 are preferably employed as aerodynamic structures, support for wall members relative to each other is provided by pins 33. In this case, four pins of rectangular cross-section are secured between each adjacent set of cylinders within the annular passage at its entry end. The pin thickness is suitable to provide overall structural integrity and the pin length may be about one-half the radial dimension of the annular passage.

As a result of the annular passage and vane design, the swirling annular air flows through annular passages 34, 36 and 38 are provided with a radial distribution of tangential velocity and a total flow volume which results in a toroidal vortex and high temperature, fuel rich combustion occurs in the combustor zone 26. Similarly, the swirling annular air flows through the annular passages 40, 42 and 44 produce a toroidal vortex and reduced temperature fuel lean combustion occurs in the combustion zone 30.

The throat section 24 separates and strengthens the toroidal vortices respectively in the rich and lean combustion zones 26 and 30. Wall cooling is provided recuperatively by the swirling air flows which sweep along the wall inner surfaces.

The basic rich/lean operation of the combustor 10 results in significantly reduced generation of thermal $NO_x$ from nitrogen in the combustion air as well as significantly reduced conversion of fuel bound nitrogen to $NO_x$.

Turbine performance requirements are met by combustor design specifications which produce the needed outlet gas flow and gas temperature. Such specifications simultaneously satisfy the described aerodynamic requirements for rich/lean toroidal combustion with recuperative wall cooling. Because of the annular structural arrangement, the combustor 10 is referred to as a multi-annular swirl burner.

In order to provide for centrifugal separation of particulate matter introduced into the rich combustion zone 26 in the fuel (such as finely pulverized coal slurry) while still producing toroidal vortex operation, annular swirling flows through the annular passages 34, 36 and 38 are provided with increasing tangential velocity component with increasing radius. Thus, the inmost swirling annular flow in the passage 34 has the lowest tangential velocity component while the flow in the outermost annular passage 38 has the highest tangential velocity component. An effective centrifugal separating force field is thus produced on particulates. Simultaneously the highest velocity outer annular flow sweeps particulates off the inner surface of the combustor wall.

It should be noted that the previously referenced patent application, Ser. No. 488,145, filed by Professor Beer employs a free vortice velocity distribution, i.e., decreasing tangential velocity with increasing radius.

In the combustor rich zone 26, the variation in tangential velocity establishes concentric shear layers in the swirling flow. A solid body type swirl occurs, i.e. $U=Cr$ where U is the tangential component of the air velocity, r is the burner radius, and C is a constant resulting from selectable burner design parameters.

By suitable selection of the constant C, premature removal of fuel particles from the hot combustion zone center to relatively cool vortice periphery P is avoided. Thus, with proper residence time for the fuel or coal particles within P, combustible gases and non-combustible ash particles move outward and toward the throat section 24. Outer wall convergence to the throat 24 increases the tangential velocity of the flow and the centrifugal forces on the flow to increase the particulate separating effect. With suitable design parameters, substantially complete particulate separation is achieved with most particulate separation occurring near or in the throat section 24.

The rotational component of the air momentum—imparted to the air by the vanes before entering the primary zone (P)—remains virtually constant when the radius decreases to that of the throat 24, and the tangential air velocity increases in the same ratio as the radius decreases. The increase in the tangential velocity results in an increase in the centrifugal force acting on the particles and they concentrate in the vicinity of the inner cylindrical surface wall of the throat 24.

Preferably, the axial length of the throat section 24 is sufficient to provide the time needed to allow required radial outward movement of particulates into a scavenge gas flow 25 for disposition in a collection system. The throat section length is thus substantially greater than the throat section length disclosed in the aforementioned application filed by Professor Beér.

Centrifugally collected particulates (ash) move from the throat section 24 through an annular opening to an annular collector 23 which is preferably located at the downstream end of the throat section 24 in line with the scavenge gas flow 25 so as to function as a tubular separator.

The scavenge gas flow which results from the described operation is approximately a few percent of the main gas flow within the throat 24.

Generally, the fractional efficiency of a tubular separator is nearly 100% for particles greater than 10 microns and about 95% for particles greater than 5 microns. Turbine blading normally can withstand particulates less than 3 microns in size.

An interconnector 41 is provided or removing the scavenge flow from the annular collector 23 of each combustor 10 to a dust manifold 42 which may be located close to the outer wall w of the turbine combustor shell. The interconnector 40 preferably is a metallic flexible coupling.

A conventional scavenge cyclone 44 is coupled to the dust manifold 40 preferably at the lowest point of the manifold. Removed particulates are deposited in a dust bin 46 where it is removed on a batch basis.

The cleaned exhaust from the cyclone 44, which is on the order of the temperature of the compressor exhaust of the turbine (650° F.–750° F. in modern turbines) proceeds into an air cooler 48 and final filter 50. The filter cleanliness requirements preferably are such that the cooled, cleaned scavenge air flow can be discharged either into an interstage bleed of the axial compressor (an intermediate pressure access to the compressor flow which is only used at start-up) or into the disc cooling air flow of the turbine. The pressure difference between the combustors and the cooling air (or the interstage bleed) provides the driving energy for the scavenge air flow across the manifold 42, cooler 48 and filter 50.

The main combustor air flow—from which the scavenge air flow has carried away the large particulate matter—enters the diverging or diffuser section of the combustor and regains most of the static pressure which was converted into kinetic energy by convergence in the upstream rich zone. Performance of the diffuser is helped by the removal of the flow boundary layer when the scavenge flow is sheared off, and by the aerodynamically suitable design of the entrance to D.

The invention can also be applied to turbines with external combustion systems. In such turbines, there are only one or two, large combustors. For a combustion system which has one or two combustors, the dust manifold is not necessary and a connector c may be directly coupled with the scavenge cyclone. If there are two combustors in the turbine, it is preferred to omit the manifold and apply one dust bin for each combustor.

Preferably, the tangential velocity of the swirling flows in the lean combustion zone also increases with radius as in the case of the rich combustion zone.

We claim:

1. A two-stage rich-lean combustor operable with reduced emission of fuel-bound and thermal nitrogen oxide products ($NO_x$), said combustor comprising:

(a) a plurality of tubular members having differing axial lengths and disposed to form a burner basket of sufficient size and axial length to contain axially spaced rich and lean combustion zones;

(b) means for supporting said tubular members substantially coaxially and telescopically relative to each other to provide a generally annular path for inlet pressurized gaseous reactant or pressurized air flowing into said combustor with predetermined axial velocity between each tubular member and the next radially outwardly disposed tubular member;

(c) means for imparting a tangential velocity to gaseous reactant entering said combustor through each annular flow path with the tangential velocity of at least the flows entering the rich combustion zone increasing with increasing flow radius;

(d) nozzle means for supplying fuel to said combustor in at least one predetermined location;

(e) said tubular members having respective axial lengths and being so disposed that the axial location of the tubular member outlet ends generally have increasing radii and respectively are located at successive downstream locations;

(f) said tangential velocity imparting means and the radial and axial geometry of at least two of said tubular members being coordinated under operating inlet gas pressure and gas axial velocity conditions to:

(1) define said rich combustion zone in an upstream portion of said combustor, where high temperature oxygen deficient combustion occurs with flame stabilizing recirculation flow and substantially without net $NO_x$ formation;

(2) produce a toroidal vortex in said rich combustion zone, with recirculating combustion air being recuperatively supplied substantially by the swirling inlet annular air flow after it has cooled the inner wall surfaces of said tubular members about said rich combustion zone; and (3) provide sufficient fuel particulate residence time in the rich combustion zone to permit particulate burning prior to centrifugal separation of particulates toward the combustor wall surface;

(g) said tangential velocity imparting means and the radial and axial geometry of at least two of said tubular members located outwardly from said tubular members about said rich combustion zone being coordinated under operating inlet gas pressure and gas axial velocity conditions to define said lean combustion zone and to produce a toroidal vortex in said lean combustion zone;

(h) said tubular members being arranged to provide a throat section into which said rich combustion zone converges and from which said lean combustion zone diverges; and (i) means for collecting and withdrawing from said combustor particulates separated from the flow as it passes through said throat section.

2. A combustor as set forth in claim 1 wherein said collecting means comprises an annular collector disposed about said throat section and extending inwardly into said throat section to shear off scavenge flow gas which contains particulate matter.

3. A combustor as set forth in claim 2 wherein a cyclone is provided for separating the particulates from the scavenge flow, means are provided for directing the scavenge flow from said collector to said cyclone.

4. A combustor as set forth in claim 3 wherein the combustor is a gas turbine combustor and means are provided for cleaning and cooling the separated gas flow from said cyclone to provide return gas flow for use in the turbine apparatus.

5. A combustor as set forth in claim 4 wherein the combustor is a gas turbine combustor and a manifold is provided for collecting scavenge flow from the annular collector of said combustor as well as from other combustors in the turbine, and means for coupling the total scavenge flow to said cyclone.

6. A combustor as set forth in claim 1 wherein said throat section has sufficient length to permit radially outward separation of particulates, and said annular collector being located near the downstream end of said throat section.

* * * * *